US009376293B2

(12) United States Patent
Willim et al.

(10) Patent No.: US 9,376,293 B2
(45) Date of Patent: Jun. 28, 2016

(54) METHOD OF ASSEMBLING A CRANE AND COUPLING SECTION, TELESCOPIC BOOM AND CRANE

(71) Applicant: Liebherr-Werk Ehingen GmbH, Ehingen (DE)

(72) Inventors: Hans-Dieter Willim, Ulm-Unterweiler (DE); Herbert Laible, Munderkingen (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 0 days.

(21) Appl. No.: 14/322,136

(22) Filed: Jul. 2, 2014

(65) Prior Publication Data

US 2015/0008205 A1 Jan. 8, 2015

(30) Foreign Application Priority Data

Jul. 4, 2013 (DE) ..... 10 2013 011 173

(51) Int. Cl.
*B66C 23/70* (2006.01)

(52) U.S. Cl.
CPC ..... *B66C 23/701* (2013.01); *B66C 23/705* (2013.01); *B66C 23/707* (2013.01); *B66C 23/708* (2013.01)

(58) Field of Classification Search
CPC .. B66C 23/708; B66C 23/705; B66C 23/344; B66C 23/701
See application file for complete search history.

(56) References Cited

U.S. PATENT DOCUMENTS

| | | | | | |
|---|---|---|---|---|---|
| 2,589,080 | A * | 3/1952 | Heinish | E21B 7/023 | 52/118 |
| 3,732,988 | A * | 5/1973 | Lamer | B66C 23/702 | 212/300 |
| 3,770,138 | A * | 11/1973 | Chalupsky | B66C 23/708 | 212/349 |
| 3,788,492 | A * | 1/1974 | Kraft | B66C 23/708 | 212/180 |
| 3,841,494 | A * | 10/1974 | Chalupsky | B66C 23/705 | 212/349 |
| 3,842,985 | A * | 10/1974 | Svede | B66C 23/708 | 212/264 |
| 4,094,230 | A * | 6/1978 | Wright | B66C 23/705 | 212/264 |
| 4,350,255 | A * | 9/1982 | Blase | B66C 23/705 | 212/296 |

(Continued)

FOREIGN PATENT DOCUMENTS

EP 2196428 A1 6/2010

*Primary Examiner* — Emmanuel M Marcelo
*Assistant Examiner* — Michael Gallion
(74) *Attorney, Agent, or Firm* — Dilworth & Barrese, LLP

(57) ABSTRACT

The invention relates to a method of assembling a crane having a telescopic boom which has a coupling section, a telescopic cylinder supported therein and at least one telescopic section, wherein at least one telescopic section is transported to the site of deployment separately from the coupling section and the at least one separately moved telescopic section is drawn, in particular drawn slowly, into an outer section, in particular into the coupling section, in the assembly position by the telescopic cylinder by means of an auxiliary assembly head.

12 Claims, 5 Drawing Sheets

(56) References Cited

U.S. PATENT DOCUMENTS 4,688,689 A * 8/1987 Barsuhn ..... B66C 23/708 212/264
4,688,690 A * 8/1987 Gattu ..... B66C 23/708 212/292
5,628,416 A * 5/1997 Frommelt ..... B66C 23/705 212/292
5,660,495 A * 8/1997 Atsukawa ..... F16B 7/10 248/405
5,893,471 A * 4/1999 Zakula ..... B66C 13/08 212/316
6,189,712 B1 * 2/2001 Conrad ..... B66C 23/705 212/292
6,216,895 B1 * 4/2001 Erdmann ..... B66C 23/708 212/292
6,474,486 B1 * 11/2002 Baraniak ..... B66C 23/705 212/292
6,520,359 B2 * 2/2003 Richter ..... B66C 23/708 212/292
6,527,131 B1 * 3/2003 Brockelmann ..... B66C 23/705 212/292
8,215,503 B2 * 7/2012 Appel ..... B66C 23/705 212/264
8,245,456 B2 * 8/2012 Anderson ..... B66C 23/707 212/231
8,689,986 B2 * 4/2014 Richter ..... B66C 23/344 212/177
8,893,905 B2 * 11/2014 Stuhrwoldt ..... B66C 23/708 212/348
9,085,443 B2 * 7/2015 Schuermann ..... B66C 23/705
9,090,438 B2 * 7/2015 Krebs ..... B66C 23/708
2010/0282700 A1 * 11/2010 Richter ..... B66C 23/36 212/177
2013/0001182 A1 * 1/2013 Willim ..... B66C 23/76 212/276

* cited by examiner a)

b)

METHOD OF ASSEMBLING A CRANE AND COUPLING SECTION, TELESCOPIC BOOM AND CRANE

BACKGROUND OF THE INVENTION

The invention relates to a method of assembling a crane having a telescopic boom which has a coupling section, a telescopic cylinder supported therein and at least one telescopic section.

Telescopic booms comprise a coupling section and a plurality of sections displaceably supported in said coupling section. The drive for telescoping the boom takes place via a telescopic cylinder which is attached at the end side in the region of the coupling section base.

It is possible in dependence on the dimensioning of the crane that the telescopic boom is too heavy for transport with the crane. In this case, the telescopic boom is dismantled for the transport and is moved to the deployment site separately from the crane. With very long and heavy telescopic booms, it may be necessary to disassemble the boom into individual telescopic sections or individual groups of telescopic sections for the transport and only to assemble it at the deployment site.

Individual telescopic sections of a telescopic boom are typically supported in one another via different support positions for a relative movement. First support points are provided at the outer periphery of the lower end at the inner telescopic section for this purpose. The support points are firmly fixed to the inner telescopic section and move with the inner telescopic section during the telescoping movement. A second support point is provided at the outer telescopic section in the region of its collar. This support point is fastened in a fixed local position at the inner periphery of the collar.

SUMMARY OF THE INVENTION

The invention deals with the assembly of a telescopic boom, in particular of a heavy telescopic boom at the site of deployment, and should in particular provide a solution for a simplified assembly procedure at the site of deployment.

This object is achieved by a method in accordance with the features herein. Advantageous embodiments of the method are also the subject of the invention.

A method is proposed for assembling a crane having a telescopic boom which has a coupling section, a telescopic cylinder supported therein and at least one telescopic section displaceably supported therein. At least one telescopic section is transported to the site of deployment separately due to the weight problem of the telescopic boom.

In accordance with the invention, the assembly of the at least one separately moved telescopic section takes place at the site of deployment with the aid of the telescopic cylinder. This is now used to slowly draw the separate telescopic section into the outer section, in particular into the coupling section. For this purpose, the telescopic section first has to be moved into the active region of the telescopic cylinder, i.e. into the assembly position.

At its first end, the telescopic cylinder is attached in the coupling section; the opposite end is free and serves the reception and the drawing in of the telescopic section to be assembled.

The method in accordance with the invention can also be used in the assembly of at least one telescopic section at the coupling section of the crane. The method embodiment is, however, suitable without restriction for the assembly of further telescopic sections at an already assembled telescopic section of the crane boom. It is furthermore conceivable that not only one individual, separately moved telescopic section is assembled in the method embodiment, but rather that a telescopic section package composed of individual telescopic sections is simultaneously assembled, wherein here the outermost telescopic section of the package is drawn into the already assembled outer telescopic section of the crane, in particular into the coupling section, by the telescopic cylinder.

The drawing procedure has to take place very slowly since there is still no complete support or exact guidance between the telescopic sections at that point in time of the assembly. The second support point, i.e. the collar support, required for operation is in particular lacking.

Since the telescopic cylinder is still not guided at the start of the assembly procedure, it is ideally supported at the inner side of the outer section, in particular at the inner side of the coupling section, by means of a prop. The support counteracts the harmful moment engaging at the outwardly telescoped telescopic cylinder.

Ideally, the prop used is longitudinally variable so that it can be regulated during the assembly in dependence on the varying spacing between the telescopic cylinder and the respective inner section. The spacing is, for example, at a maximum on the assembly of a telescopic section at the coupling section. If, however, the method is carried out for the assembly of a further telescopic section at an already assembled telescopic section in the interior of the coupling section, the length of the prop has to be adapted or reduced respectively.

An auxiliary crane to which the telescopic section to be assembled is connected in particular serves to move the separately moved telescopic section into the mounting region of the telescopic cylinder. The auxiliary crane conveys the connected telescopic section into the assembly position.

The end piece of the telescopic section preferably reaches slightly into the inner space of the other section in the assembly position, until a bolting system for bolting the at least two sections contacts the collar of the outer section.

The outer section, in particular the coupling section, expediently comprises introduction aids which facilitate the introduction of the telescopic section to be assembled with the aid of the auxiliary crane. As soon as the telescopic section to be assembled reaches into the inner space of the outer section, the first support point of the sections engages which is usually provided at the outer periphery of the end piece of the telescopic section to be assembled.

This individual first support point is, however, not sufficient for a proper guidance of the telescopic section so that it can only be displaced very slowly with the aid of the telescopic cylinder.

On reaching the assembly position, the telescopic cylinder is moved out and is preferably automatically connected to the at least one telescopic section. Ideally, a bolting system of the telescopic section is unlocked by the telescopic cylinder simultaneously or within a narrow time frame so that a relative pushing movement of the telescopic cylinder to the outer section is possible.

In a preferred embodiment of the method, the telescopic cylinder draws the at least one telescopic section so far in until a bolting is possible between the outer section and the drawn in section. The telescopic cylinder particularly preferably actuates the bolting system so that the inner and outer sections are bolted to one another, while the connection of the telescopic cylinder to the drawn in telescopic section is automatically released simultaneously or within a narrow time frame.

At least one bolt connection is expediently engaged at all times, that is either the bolt connections between the telescopic sections (including the coupling section) or the bolt connection between the telescopic section and the telescopic cylinder. This means that the new bolt connection is always established first and only then is the old bolt connection released.

The end piece of the now assembled telescopic section ideally has a guide for the telescopic cylinder so that the otherwise required prop can be moved in. The moved-in prop thus no longer represents any obstacle when the telescopic cylinder moves into the inner region of the telescopic section to be drawn in.

The outer section, in particular the coupling section, is held in its luffing position via the regular crane guying during the assembly procedure. Once the assembly of the telescopic boom has been completed, the guying is expanded onto the assembled telescopic sections and is connected to them.

The assembly of the second support point is necessary for the regular crane operation or telescopic operation of the boom. It is either subsequently attached in the collar region of the outer telescopic section or is already automatically introduced into the position in the collar region of the outer telescopic section provided for this purpose during the assembly of the telescopic section.

In an advantageous embodiment of the method in accordance with the invention, the crane support is moved into its provided position at the collar of the outer section by means of a guide frame supported on the at least one telescopic section by the drawing in of the at least one telescopic section. In this case, the guide frame first has to be fixedly connected to the at least one telescopic section to draw the guide frame into the inner space of the outer section together with the telescopic section.

As soon as the outer and inner telescopic sections are bolted to one another, the connection between the guide frame and the drawn-in telescopic section is released simultaneously or within a narrow time frame and a fixed connection with the outer section is entered into. This guide frame carries the crane support which then forms the support point in the collar region of the outer section. The telescopic boom is now completely functional.

Ideally, the guide frame is positioned and bolted first and subsequently the bolting between the telescopic sections (including the coupling section) is established.

In addition to the method in accordance with the invention, the present invention relates to a coupling section for a crane having a telescopic boom, wherein the coupling section has a telescopic cylinder for carrying out the method in accordance with the invention or an advantageous embodiment of the method. The advantages and properties of the coupling section in accordance with the invention obviously correspond to those of the method in accordance with the invention so that a repeat description will be dispensed with at this point.

The coupling section, i.e. the telescopic cylinder, preferably comprises at least one prop, in particular a longitudinally variable prop, which is suitable for supporting the telescopic cylinder against the inner side of the coupling section or of an inner telescopic section supported therein. The prop is in particular actively controllable, preferably hydraulically actuable.

In an advantageous embodiment, the telescopic cylinder furthermore comprises an auxiliary assembly head which allows an automatic connection to a telescopic section to be drawn in. The auxiliary assembly head furthermore comprises means for actuating the bolting system of a telescopic section. The assembly head is in particular configured such that on the connection procedure of the telescopic cylinder with at least one telescopic section, the corresponding bolting system of the telescopic section is unlocked simultaneously or within a narrow time frame. Ideally, at least one bolt connection is engaged at all times, that is either the bolt connections between the telescopic sections (including the coupling section) or the bolt connection between the telescopic section and the telescopic cylinder. This means that the new bolt connection is always established first and only then is the old bolt connection released.

At least in introduction aid, in particular in the form of a chamfer, is provided at the collar of the coupling section for the simplified introduction of a telescopic section to be assembled into the inner region of the outer section, in particular of the coupling section. If an auxiliary crane required for the assembly uses a slight diagonal pull, a simplified introduction of the telescopic section is hereby effected.

In an advantageous embodiment of the coupling section, the at least one prop and/or the auxiliary assembly head is hydraulically actuable. The hydraulic supply ideally takes place by the hydraulic circuit of the telescopic cylinder.

The invention further relates to a telescopic boom having a coupling section in accordance with the present invention. The telescopic boom is suitable for carrying out the method in accordance with the invention. In an advantageous embodiment, a guide frame having a collar support can furthermore be provided, the guide frame being selectively releasably connectable to the section to the assembled or to the outer section. The guide frame allows an automatic installation of the crane support so that the proper setup conditions are established and the telescopic boom is completely functional without any further human intervention after the assembly procedure.

The telescopic boom can be structured in a lattice construction or also in a metal plate construction, for example. A mixed form of both types of construction is also conceivable.

The invention finally relates to a crane having a telescopic boom in accordance with the present invention which is suitable for carrying out the method in accordance with the invention.

BRIEF DESCRIPTION OF THE DRAWINGS

Further advantages and properties of the invention will be explained in detail with reference to an embodiment shown in the drawings. There are shown.

DESCRIPTION OF THE PREFERRED EMBODIMENTS

Figure 1:
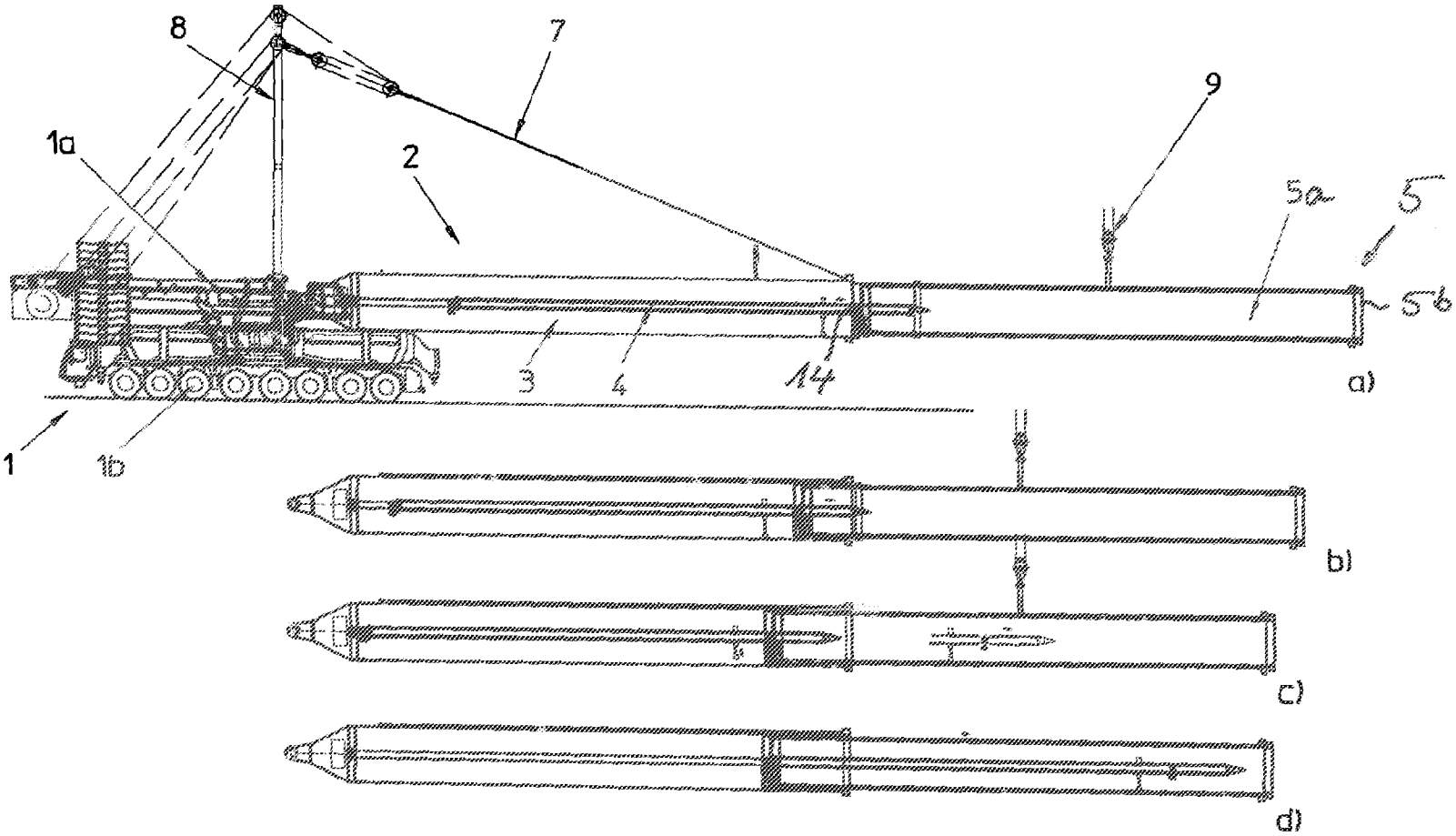
FIG. 1: the telescopic boom in accordance with the invention during the individual assembly steps of the method in accordance with the invention.

A crane 1 having a telescopic boom 2 is shown in FIG. 1, the telescopic boom having a coupling section 3, a telescopic cylinder 4 and at least one telescopic section 5. The telescopic boom 2 is transported to the site of deployment separately from the crane 1. In addition, for weight reasons, at least one telescopic section 5 or a telescopic section package comprising a plurality of telescopic sections is moved separately from the coupling section 3 and is subsequently assembled at the site of deployment with the aid of an auxiliary crane 9.

After the crane transport, the crane is therefore brought into the work-capable state at the construction site. The crane superstructure 1*a* is placed onto the crane undercarriage 1*b* for this purpose. The coupling section 3 is subsequently connected to the crane superstructure 1*a*. The coupling section 3 can represent one transport alone or alternatively also already contain one or more telescopic sections 5. The telescopic cylinder 4 is in any case contained in the coupling section.

The telescopic cylinder 4 is connected at its lower end to the foot of the coupling section 3. The oppositely disposed end of the telescopic cylinder 4 is free and can be moved out in the direction of the boom head.

Figure 2:
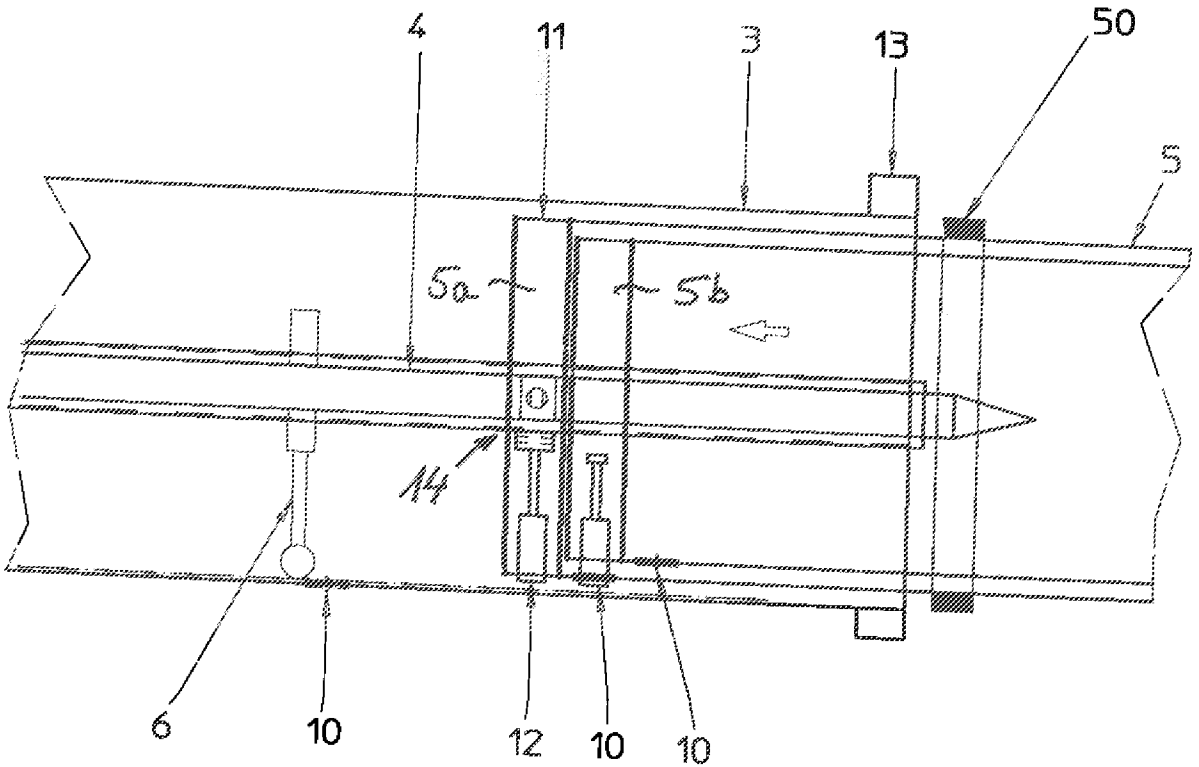
FIG. 2: a detailed view of the telescopic boom in accordance with the invention.

To hold off the harmful moment from the telescopic cylinder 4 during the extension movement of the piston rod of the cylinder 4, the telescopic cylinder 4 is supported against the inner side of the coupling section 3 with the aid of the active prop 6 (see FIG. 2). The prop 6 is longitudinally variable and is hydraulically actuated. The hydraulic supply takes place via the hydraulic supply of the telescopic cylinder 4.

At the start of the assembly process (see FIG. 1*a*), the coupling section 3 is held horizontally by the guying 7 and the guying frame 8. The telescopic cylinder 4 is completely moved in and is supported on the prop 6. A telescopic section package 5 having the two telescopic sections 5*a*, 5*b* which is to be assembled is connected at the auxiliary crane 9 and brought into the assembly position in the vicinity of the collar of the coupling section 3. The section 5*a* forms the outer telescopic section of the package 5. Both sections 5, 5*b* are bolted to one another.

The telescopic package 5, in particular the outer telescopic section 5*a*, has to project at the end side a little into the inner space of the coupling section 3 for the reception thereof by the telescopic cylinder 4. To simplify this procedure, introduction aids in the form of chamfers are provided both at the coupling section 3 and at the telescopic section 5*a*. The telescopic section package 5 is furthermore received by the auxiliary crane 9 with a small diagonal pull. The telescopic section package 5 is hereby pressed against the coupling section 3 and the provided chamfers come into effect.

A first centration is achieved by the introduction of the package 5 and the first support point of the outer telescopic section 5*a* comes into effect.

As known from the prior art, a connection system is provided in the form of a plurality of bolt connections between adjacent telescopic sections. In this respect, it can, for example, be a fourfold bolting—in accordance with the not prepublished patent application DE 10 2012 002 122—or also any other desired bolting, for example a lower web bolting in accordance with the not prepublished patent application DE 10 2013 006 259. In the assembly position, the end piece 11 of the outer telescopic section 5*a* projects so far into the inner space of the coupling section 3 until the bolt or bolts 12 of the telescopic section 5*a* contact the collar 13 of the coupling section 3 (FIG. 1*a*). The overlap of the sections 3, 5*a* is still extremely small at this time.

In the following step, the telescopic cylinder is moved out until the auxiliary assembly head 14 in accordance with the invention is in the actuation position for the actuable bolt 12. The auxiliary assembly head 14 can connect to the telescopic section 5*a* itself and then unlock the bolt 12, i.e. can draw it in in the direction of the longitudinal axis of the telescopic section 5*a* to cancel a possible bolt connection or a blocking of a relative movement. The telescopic section package 5 is now displaceable in the inner space of the coupling section 3.

The telescopic section 5 is drawn into the coupling section 3 by a slow moving in of the telescopic cylinder 4. Since the major part of the weight of the telescopic section 5 is held by the auxiliary crane 9 and the first support point in the end region 11 of the telescopic section 5*a* is already in engagement with the coupling section 3, the auxiliary assembly head 14 can be made very light. In addition, all safety functions do not have to be included since the auxiliary assembly head 14 only works in the unloaded state, i.e. in the set-up state. The drawing in of the telescopic section package 5 takes place very slowly since no complete support and no exact guidance is present between the telescopic sections, i.e. of the coupling section 3 and of the telescopic section 5. The required second support point in the region of the collar 13 of the coupling section 3 is missing.

To ensure a simultaneous installation of the collar support during the installation of the telescopic section package 5, the guide frame 50 fixed on the outer periphery of the telescopic section 5*a* (see FIG. 2) is also drawn in the direction of the collar 13 of the coupling section 3 together with the telescopic section 5*a*. This guide frame 50 contains the known and required second support point between the coupling section 3 and the telescopic section 5*a*. This support point can also be provided with the introduction aids already described above, whereby its assembly is simplified. The operation of the guide frame 50 will be taken up at a later point of the description and will be explained with reference to FIGS. 3 and 4.

The telescopic cylinder 4 draws the telescopic section package 5 so far into the inner space of the coupling section 3 (see FIG. 1*c*) until the bolts 12 of the telescopic section 5*a* reach the matching counter-points of the coupling section 3. On reaching the target position, the assembly head 14 releases the bolts 12 which are then automatically plugged into suitable bores 10 of the counter-elements 10 at the coupling section 3. At the same time or within a narrow time frame, the connection between the assembly head 14 and the telescopic section 5*a* is automatically separated.

The guide frame 50 reaches the collar 13 of the coupling section 3 on reaching the target position, whereby the second support point between the coupling section 3 and the telescopic section 5*a* is operational. The telescopic boom 2 is now operational. If necessary, there is the possibility of assembling further telescopic sections by a repetition of the assembly procedure in the same manner at the respective innermost telescopic section 5*b*. This target position can already be reached before the reaching of the bolting position between the telescopic sections.

Since the end piece 11 has a guide for the telescopic cylinder 4, the prop 6 can be moved in after assembly has taken place. This now no longer represents any obstacle and the telescopic cylinder 4 can be moved out without problem into the inner region of the inner telescopic section 5*b* (FIGS. 1*c*/1*d*). If required, the prop 6 can be moved out again in the hollow space of the telescopic section 5*b* and be supported against its inner wall, for example for the assembly of any additional telescopic sections.

After the assembly of the telescopic boom 2 has been completed, the guying 7 is connected to the assembled telescopic section package 5 which is moved out for the impending lifting work. The hydraulic supply of the auxiliary assembly head 14 takes place by the already present hydraulic supply of the telescopic cylinder 4. A supply of the active prop 6 can thus also take place.

The disassembly of the crane boom 2 takes place accordingly in the reverse order. In general, the telescopic boom 2 can be designed in metal plate construction, as in the embodiment shown. The method can, however, be used without restrictions on telescopic booms in a lattice construction or on boom systems which are composed of a mixed form of the named types of construction.

Figure 3:
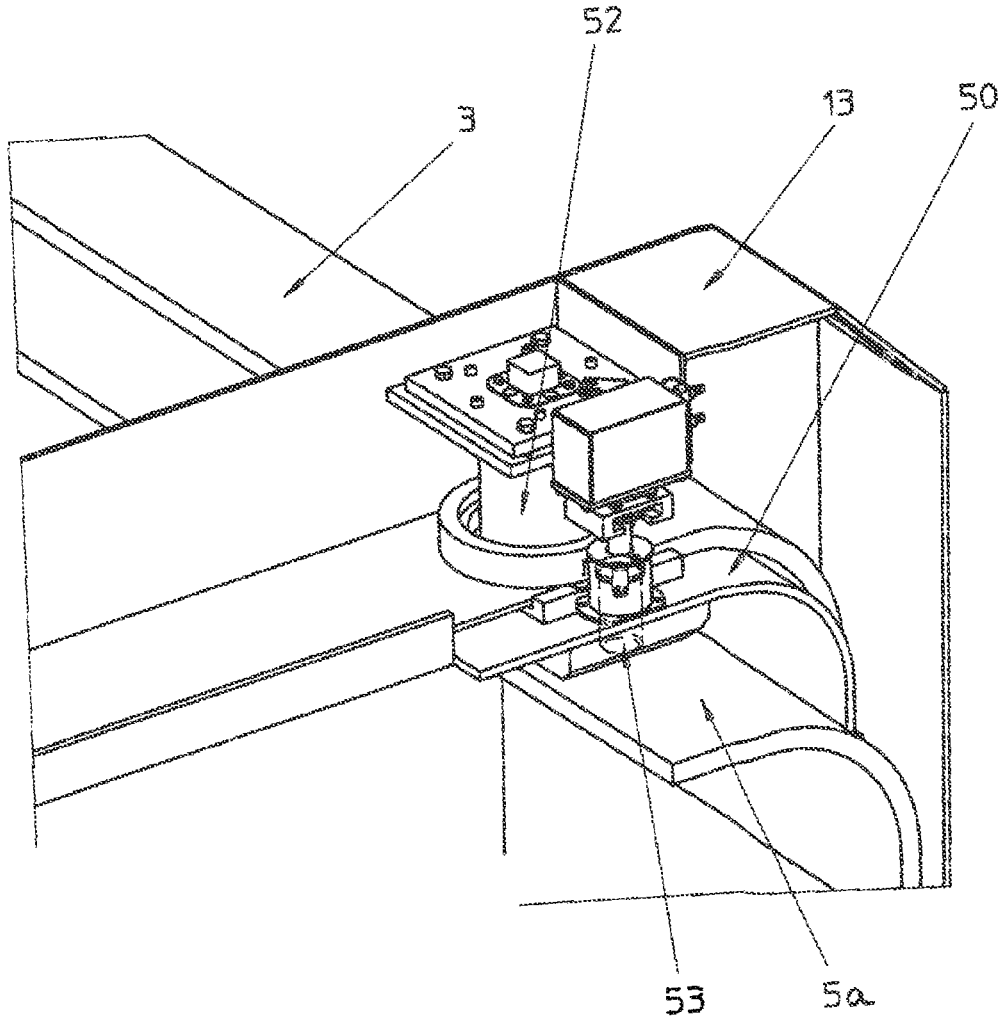
FIG. 3: a perspective detailed view of the guide frame.
Figure 4:
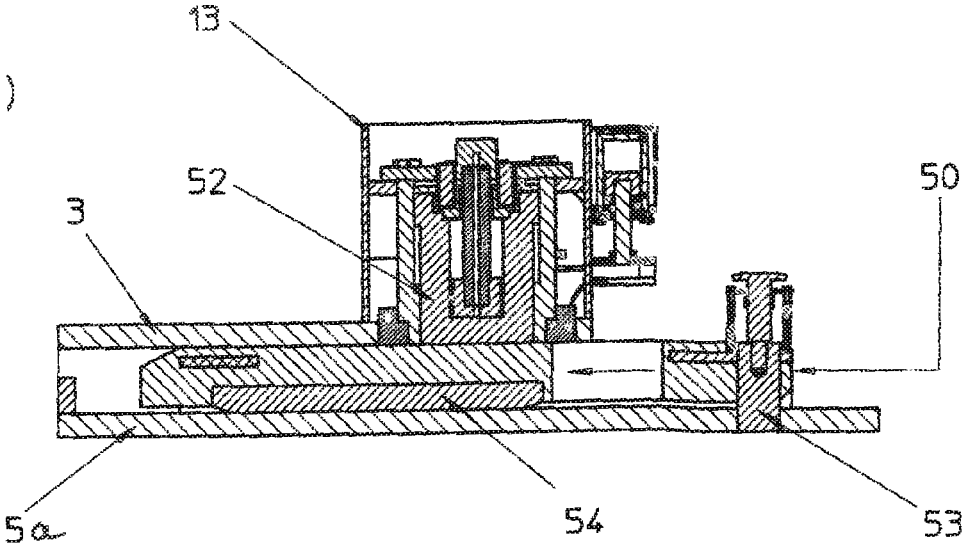
FIG. 4: various sectional representations through the guide frame during different assembly steps of the method in accordance with the invention.
Figure 4:
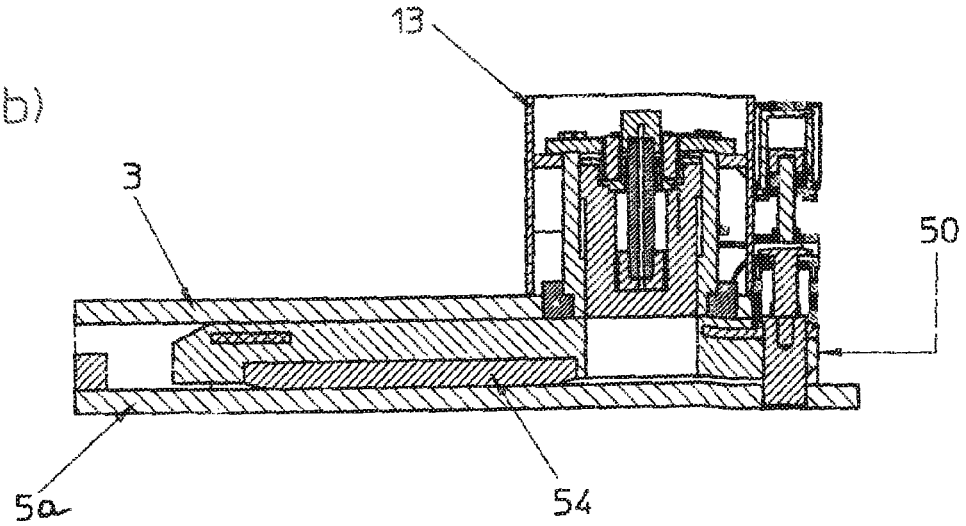
Figure 4:
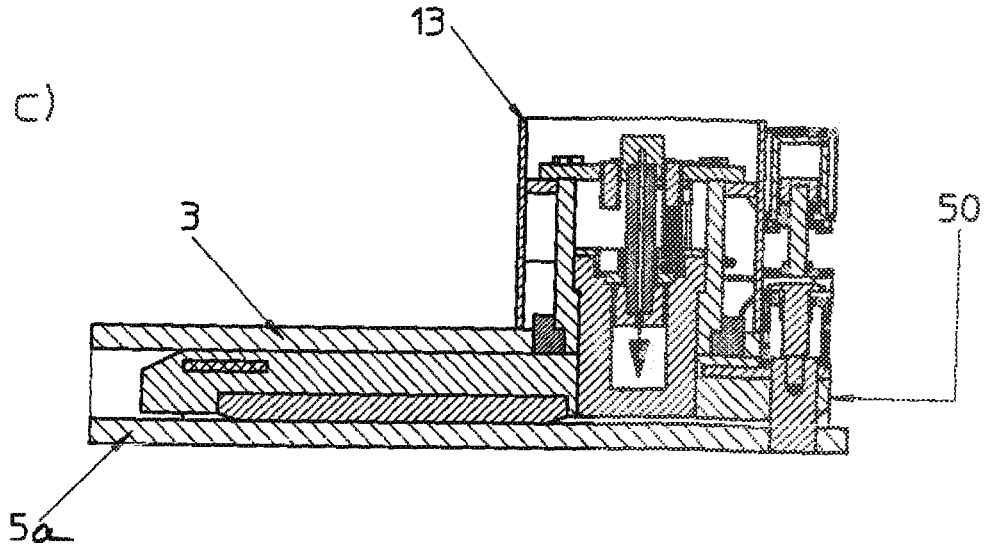
Figure 4:
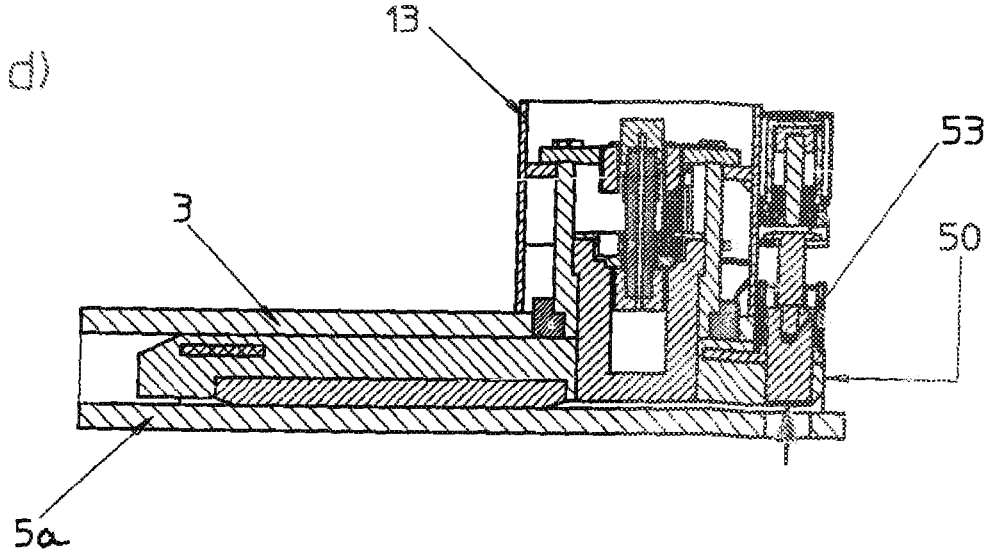

In the following, the basic operation of the guide frame 50 in accordance with the invention will be looked at in more detail with the aid of the Figure representations of FIGS. 3, 4. At the start of the method, the guide frame 50 is seated on the outer periphery of the telescopic section 5*a* (see Figure; FIGS. 1*a*, 1*b* and 2) and is fixedly connected to the telescopic section 5*a* in this position via the connection bolt 53 which is inserted into a suitable bore at the outer periphery of the telescopic section 5*a*. The connection can take place via one or more bolt connections of the type shown. A fourfold bolting having one respective bolt connection per frame corner is sensible.

The bolt mechanism of the connection bolts 53 is automatic so that they also remain in the respective position after actuation has taken place without a constant energy supply.

If the telescopic section 5*a* is drawn into the inner space of the coupling section 3 with the aid of the telescopic cylinder 4, the guide frame 50 also migrates in the direction of the collar 13 of the coupling section 3 until the latter reaches the provided position (FIG. 3 and from FIG. 4*b* onward) in the collar region of the coupling section 3. At the collar region, a bolt mechanism is installed having a bolt 52 of large dimensions which can be plugged into the suitable bore of the guide frame 50. This bolt connection 52 ensures that the telescopic cylinder 4 does not accidentally push out the guide frame 50. The guide frame 50 is thus fixedly connected to the coupling section 3 and to the telescopic section 5*a* (see FIG. 4*c*).

Subsequently, the at least one connection bolt 53 is drawn to release the bolt connection between the guide frame 50 and the telescopic section 5*a*. The telescopic section 5*a* can now slide over the second support point connected at a fixed location to the collar 13 of the coupling section 3. The support point at the guide frame 50 is formed by the shown support shoe 54 which is arranged at the lower side of the frame.

The supply lines, in particular hydraulic lines, are preferably guided outside the coupling section 3 in the longitudinal direction of the boom. To supply the further telescopic sections 5 in accordance with the method presented, hydraulic connections are manually established between the sections by the crane operator and are released once assembly is complete. It is necessary for this reason that the respective connection bolts 53 also remain automatically in the current bolt position without a hydraulic supply.

Corresponding sensors can be arranged at the telescopic boom 2 for monitoring the bolt position of the connection bolts 53 and of the bolt 52. The integration of one or more proximity switches which detect the respective bolt position and communicate it to the crane control is particularly suitable.

The invention claimed is:

1. A method of assembling separate components of a crane having a telescopic boom which has a coupling section, a telescopic cylinder supported therein and at least one telescopic section detached therefrom, comprising the steps of transporting the at least one telescopic section to a site of deployment separately from transporting the coupling section to the site of deployment, drawing the at least one separately-transported telescopic section into the outer coupling section, in an assembly position, by action of the telescopic cylinder and an auxiliary assembly head, connecting the at least one telescopic section with an auxiliary crane and bringing the at least one telescopic section into the assembly position for drawing in, and bringing an end piece of the at least one telescopic section into an inner space within the outer section by the auxiliary crane in the assembly position until a bolting system for bolting at least two sections contacts a collar of the outer section.

2. A method in accordance with claim 1, wherein the telescopic cylinder is supported against an inner side of the outer section with a prop arranged at the telescopic cylinder.

3. A method in accordance with claim 1, wherein the telescopic cylinder is moved out on reaching the assembly position and is automatically connected to the at least one telescopic section, with the telescopic cylinder unlocking the bolting system of the at least one telescopic section.

4. A method in accordance with claim 1, wherein the telescopic cylinder draws in the at least one telescopic section until a bolting is possible between the outer section and the drawn in section which actuates the bolting system and which automatically releases the connection to the drawn in telescopic section.

5. A method in accordance with claim 1, wherein the coupling section is guyed by a crane guying during the assembly procedure.

6. A method in accordance with claim 1, wherein a support for the at least one telescopic section at the collar is brought into its provided position at the collar of the outer section by a guide frame supported at the at least one telescopic section by the drawing in of the at least one telescopic section.

7. A coupling section for a crane having a telescopic boom, wherein the coupling section has an outer section configured for receiving an end of the telescopic boom, and a telescopic cylinder configured for insertion into both the outer section and the telescopic boom and drawing the end of the telescopic boom into the outer section wherein the outer section (3) comprises a collar (13) around an open end thereof configured to receive an end (11) of the telescopic boom (5*a*), the telescopic cylinder (4) comprises a longitudinally-variable prop (6) configured to support the telescopic cylinder (4) along an inner surface of the outer section (3), an auxiliary crane (9) is arranged to support the end (11) of the boom for insertion into the outer section (3), a movable bolt (52) is mounted at the collar (13) of the outer section (3) and arranged to seat in a bore of a guide frame (50) at the end (11) of the telescopic boom (5*a*), the guide frame (50) being coupled to the end (11) of the telescopic boom (5*a*) through a connection bolt (53), means are provided for releasing the connection bolt (53) between the guide frame (50) and the end (11) of the telescopic boom (5*a*) such that the end (11) of the telescopic boom (5*a*) is slidable into the coupling section (3) along a support shoe (54) on the guide frame (50), and the telescopic cylinder (4) comprises an auxiliary assembly head (14) arranged to retract a bolt (12) movably positioned on the end (11) of the boom (15) and release the bolt (12) to seat in a counter bore (10) on the inner surface of the outer section (3).

8. A coupling section in accordance with claim 7, wherein at least one introduction aid is provided at the collar of the coupling section.

9. A coupling section in accordance with claim 7, wherein the at least one prop and/or the auxiliary assembly head is/are hydraulically actuable, with its hydraulic supply being provided by a hydraulic supply of the telescopic cylinder.

10. A telescopic boom in accordance with claim 7, wherein the telescopic boom has lattice constriction, a metal plate construction or a mixed form of both manners of construction.

11. A method in accordance with claim 1, wherein the at least one telescopic section is drawn into the coupling section by the steps of connecting the coupling section (3) to a superstructure (1*a*) of the crane (1) and supporting the coupling section (3) with guying (7, 8), inserting the telescopic cylinder (4) into the coupling section (3) and connecting the telescopic cylinder (4) to an inner end of the coupling section (3), such that an opposite end of the telescopic cylinder (4) is movable out of the coupling section (3) in a direction of a head of the boom, inserting said at least one telescopic section (5) into the coupling section (3), extending the telescopic cylinder (4) and coupling the telescopic cylinder (4) to the at least one telescopic section (5), retracting the telescopic cylinder (4) and drawing the at least one telescopic section (5) into the coupling section (3), releasing bolts (12) on the at least one telescopic section (5) to automatically plug bores (10) in the coupling section (3) and releasing coupling between the telescopic cylinder (4) and the at least one telescopic section (5), and uncoupling the guying (7,8) from the coupling section (3) and coupling the guying (7,8) to the at least one telescopic section (5).

12. A method in accordance with claim 11, comprising the additional steps of coupling the collar (13) of the outer section to a guide frame (50) situated on the end (11) of the at least one telescopic section (5*a*) through a first bolt (52), releasing a second bolt (53) coupling the guide frame (50) and at least one telescopic section (5*a*), and sliding the at least one telescopic section (5*a*) along a support shoe (54) located on a inner side of the guide frame (50).

* * * * *